US011046567B2

(12) United States Patent
Hayakawa et al.

(10) Patent No.: US 11,046,567 B2
(45) Date of Patent: Jun. 29, 2021

(54) BEVERAGE ASEPTIC FILLING SYSTEM AND CARBONATED BEVERAGE ASEPTIC FILLING SYSTEM

(71) Applicant: Dai Nippon Printing Co., Ltd., Tokyo (JP)

(72) Inventors: Atsushi Hayakawa, Tokyo (JP); Hideyuki Matsubara, Tokyo (JP); Takayoshi Kuriyama, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 16/480,790

(22) PCT Filed: Feb. 1, 2018

(86) PCT No.: PCT/JP2018/003415
§ 371 (c)(1),
(2) Date: Jul. 25, 2019

(87) PCT Pub. No.: WO2018/143348
PCT Pub. Date: Sep. 8, 2018

(65) Prior Publication Data

US 2019/0389710 A1 Dec. 26, 2019

(30) Foreign Application Priority Data

Feb. 2, 2017 (JP) ..... JP2017-017725
Feb. 2, 2017 (JP) ..... JP2017-017736

(51) Int. Cl.
*B67C 7/00* (2006.01)
*B67C 3/10* (2006.01)
(Continued)

(52) U.S. Cl.
CPC ..... *B67C 7/0073* (2013.01); *B67C 3/10* (2013.01); *B67C 3/20* (2013.01); *B67C 3/28* (2013.01); *B67C 2003/228* (2013.01)

(58) Field of Classification Search
CPC ..... B67C 7/0073; B67C 3/10; B67C 3/20; B67C 3/28; B67C 2003/228; B67C 7/00; B67C 3/02; B65B 55/10; B65B 55/02
(Continued)

(56) References Cited

U.S. PATENT DOCUMENTS 4,416,194 A 11/1983 Kemp
2010/0037984 A1* 2/2010 Hiroya ..... B67C 7/0073 141/59
2015/0298178 A1* 10/2015 Hayakawa ..... B67C 3/005 134/22.1

FOREIGN PATENT DOCUMENTS

JP H10-157799 A1 6/1998
JP 2006-211931 A1 8/2006
(Continued)

OTHER PUBLICATIONS

JP-2015223150-A English Translation of Specification (Year: 2020).*
(Continued)

*Primary Examiner* — Timothy P. Kelly
*Assistant Examiner* — Stephanie A Shrieves
(74) *Attorney, Agent, or Firm* — Burr & Brown, PLLC

(57) ABSTRACT

A beverage aseptic filling system for both a carbonated beverage and a non-carbonated beverage includes a raw material liquid preparation unit that prepares a raw material liquid, a beverage sterilization unit that sterilizes a beverage, a beverage filling unit that fills a container with a beverage, and a switching valve provided between the beverage sterilization unit and the beverage filling unit. A first filling line is provided between the switching valve and the beverage filling unit, and the switching valve is connected to a second
(Continued)

filling line, in which a beverage cooling unit for cooling a beverage and a carbonated beverage production unit for injecting carbon dioxide gas into a beverage are disposed. The switching valve supplies a beverage to either one of the first filling line and the second filling line selectively.

9 Claims, 3 Drawing Sheets

(51) Int. Cl.
*B67C 3/20* (2006.01)
*B67C 3/28* (2006.01)
*B67C 3/22* (2006.01)

(58) Field of Classification Search
USPC ..... 141/92
See application file for complete search history.

(56) References Cited

FOREIGN PATENT DOCUMENTS

| | | | | | |
|---|---|---|---|---|---|
| JP | 2010-202206 | A1 | | 9/2010 | |
| JP | 4674743 | B2 | | 4/2011 | |
| JP | 2015-223150 | A1 | | 12/2015 | |
| JP | 2015223150 | A | * | 12/2015 | |
| WO | 2014/077319 | A1 | | 5/2014 | |
| WO | WO-2014098058 | A1 | * | 6/2014 | ..... B67C 3/001 |
| WO | WO-2014208551 | A1 | * | 12/2014 | ..... B08B 3/10 |

OTHER PUBLICATIONS

WO-2014208551-A1 English Translation of Specification (Year: 2020).*
WO-2014098058-A1 English Translation of Specification (Year: 2020).*
International Search Report and Written Opinion (Application No. PCT/JP2018/003415) dated Mar. 20, 2018.
Japanese Office Action (Application No. 2017-017725) dated Nov. 7, 2017 (with English translation).
Japanese Office Action (Application No. 2017-017725) dated Mar. 9, 2018 (with English translation).
Japanese Office Action (Application No. 2017-017736) dated Oct. 27, 2017 (with English translation).
English translation of International Preliminary Report on Patentability (Chapter I) (Application No. PCT/JP2018/003415) dated Aug. 15, 2019, 16 pages.
Extended European Search Report (Application No. 18747418.4) dated Oct. 22, 2020.
Chinese Office Action (Application No. 201880010085.8) dated Nov. 30, 2020 (with English translation).

* cited by examiner

BEVERAGE ASEPTIC FILLING SYSTEM AND CARBONATED BEVERAGE ASEPTIC FILLING SYSTEM

BACKGROUND OF THE INVENTION

Field of the Invention

The present invention relates to a beverage aseptic filling system and a carbonated beverage aseptic filling system.

Background Art

Conventionally, a container with a beverage including a carbonated beverage containing components derived from animals or plants, such as fruit juice and a milk component, has been manufactured. In this case, first, a container (PET bottle) is filled with a carbonated beverage, and then heat sterilization treatment for heating the carbonated beverage together with the container is performed. By performing the heat sterilization treatment, proliferation of mold, yeast and other microorganisms in the carbonated beverage can be suppressed. For example, in a case of a carbonated beverage containing fruit juice, carbon dioxide gas is injected at a low temperature into a liquid preparation obtained by mixing nitrogen sources, such as fruit juice and a milk component. After the above, a container is filled with the liquid preparation in which carbon dioxide gas is dissolved, and the container is sealed with a cap. Next, the carbonated beverage with which the container is filled is applied with heat sterilization treatment from the outside of the container, so that the carbonated beverage and the container are sterilized simultaneously. The heat sterilization treatment is generally performed under the condition that the carbonated beverage is heated at a liquid temperature of 60° C. or more and 65° C. or less for about 10 minutes.

CITATION LIST

Patent Literature

Patent Literature 1: JP 2006-211931 A
Patent Literature 2: JP 4674743 B2

However, in a case where the conventional heat sterilization treatment is performed, the content made up of a carbonated beverage, for example, a content liquid containing nitrogen sources, such as fruit juice and a milk component, may be changed in quality. Further, since the container is expanded at the time of the heat sterilization treatment, disadvantages, such as deformation of the container, occur. For this reason, it is considered not to perform heat sterilization treatment by filling a container with a carbonated beverage using an aseptic filling facility.

In a case where a container is filled with a carbonated beverage using an aseptic filling facility as described above, the aseptic filling facility is provided with a dedicated sterilizer (carbonator or the like) to be filled with the carbonated beverage. For this reason, conventionally, there has been a problem that it is difficult to use an aseptic filling facility for filling a container with a carbonated beverage directly as an aseptic filling facility for filling a container with a non-carbonated beverage.

On the other hand, some carbonated beverages, such as cola and soda, do not require a sterilization process (non-sterilized carbonated beverages). For this reason, in a case where an aseptic filling facility for filling a container with carbonated beverages (sterilized carbonated beverages) that require sterilization is used directly as an aseptic filling facility for non-sterilized carbonated beverages, non-sterilized carbonated beverages that do not require sterilization are also caused to pass through a sterilizer. In this case, it is necessary to perform useless work, such as cleaning and sterilizing the sterilizer by, for example, CIP treatment.

The present invention has been made in consideration of the above, and an object of the present invention is to provide a beverage aseptic filling system that can fill a container with both a carbonated beverage and a non-carbonated beverage using the same beverage aseptic filling system. Further, an object of the present invention is to provide a carbonated beverage aseptic filling system that is capable of efficiently filling a container with both a sterilized carbonated beverage for which sterilization treatment is performed and a non-sterilized carbonated beverage that does not require sterilization using the same carbonated beverage aseptic filling system.

SUMMARY OF INVENTION

The present invention is a beverage aseptic filling system for both a carbonated beverage and a non-carbonated beverage, the beverage aseptic filling system including a raw material liquid preparation unit that prepares a raw material liquid, a beverage sterilization unit that is connected to the raw material liquid preparation unit and sterilizes a beverage, a beverage filling unit that fills a container with the beverage, a switching valve that is provided between the beverage sterilization unit and the beverage filling unit, a first filling line that is provided between the switching valve and the beverage filling unit, and a second filling line that is connected to the switching valve and has a beverage cooling unit for cooling the beverage and a carbonated beverage production unit for injecting carbon dioxide gas into the beverage disposed therein, wherein the switching valve supplies the beverage to either one of the first filling line and the second filling line selectively.

The present invention is the beverage aseptic filling system, wherein, in a case where a beverage with which the container is filled by the beverage filling unit is a carbonated beverage, the beverage from the switching valve is supplied to the beverage filling unit via at least the second filling line, and, in a case where a beverage with which the container is filled by the beverage filling unit is a non-carbonated beverage, the beverage from the switching valve is supplied to the beverage filling unit via the first filling line without passing through the second filling line.

The present invention is the beverage aseptic filling system, wherein the second filling line is configured in a loop, and a beverage from the second filling line is sent to the first filling line via the switching valve.

The present invention is the beverage aseptic filling system, wherein the raw material liquid preparation unit and the beverage cooling unit are connected by a third filling line not via the beverage sterilization unit.

The present invention is the beverage aseptic filling system, wherein a first aseptic tank for storing the beverage from the beverage sterilization unit is provided between the beverage sterilization unit and the switching valve.

The present invention is the beverage aseptic filling system, wherein a second aseptic tank for storing the beverage from the carbonated beverage production unit is provided between the carbonated beverage production unit and the beverage filling unit.

According to the present invention, a container can be filled with both a carbonated beverage and a non-carbonated beverage by using the same beverage aseptic filling system.

The present invention is a carbonated beverage aseptic filling system for both a sterilized carbonated beverage for which sterilization treatment is performed and a non-sterilized carbonated beverage that does not require sterilization, the carbonated beverage aseptic filling system including a raw material liquid preparation unit that prepares a raw material liquid, a beverage sterilization unit that is connected to the raw material liquid preparation unit and sterilizes a beverage, a beverage cooling unit that is connected to the beverage sterilization unit and cools the beverage, a carbonated beverage production unit that is connected to the beverage cooling unit and injects carbon dioxide gas into the beverage, and a beverage filling unit that is connected to the carbonated beverage production unit and fills a container with the beverage, wherein the raw material liquid preparation unit and the beverage cooling unit are connected by a first bypass filling line not via the beverage sterilization unit.

The present invention is the carbonated beverage aseptic filling system, wherein a first aseptic tank for storing the beverage is provided between the beverage sterilization unit and the beverage cooling unit.

The present invention is the carbonated beverage aseptic filling system, wherein the raw material liquid preparation unit and the first aseptic tank are connected by a second bypass filling line not via the beverage sterilization unit.

The present invention is the carbonated beverage aseptic filling system, wherein a second aseptic tank for storing the beverage from the carbonated beverage production unit is provided between the carbonated beverage production unit and the beverage filling unit.

The present invention is a carbonated beverage aseptic filling system for both a sterilized carbonated beverage for which sterilization treatment is performed and a non-sterilized carbonated beverage that does not require sterilization, the carbonated beverage aseptic filling system including a raw material liquid preparation unit that prepares a raw material liquid, a beverage sterilization unit that is connected to the raw material liquid preparation unit and sterilizes a beverage, a first aseptic tank that is connected to the beverage sterilization unit and stores the beverage, a beverage cooling unit that is connected to the first aseptic tank and cools the beverage, a carbonated beverage production unit that is connected to the beverage cooling unit and injects carbon dioxide gas into the beverage, and a beverage filling unit that is connected to the carbonated beverage production unit and fills a container with the beverage, wherein the raw material liquid preparation unit and the first aseptic tank are connected by a second bypass filling line not via the beverage sterilization unit.

According to the present invention, the same carbonated beverage aseptic filling system can be used to efficiently fill a container with both a sterilized carbonated beverage for which sterilization treatment is performed and a non-sterilized carbonated beverage that does not require sterilization.

DETAILED DESCRIPTION OF THE INVENTION

Figure 1:
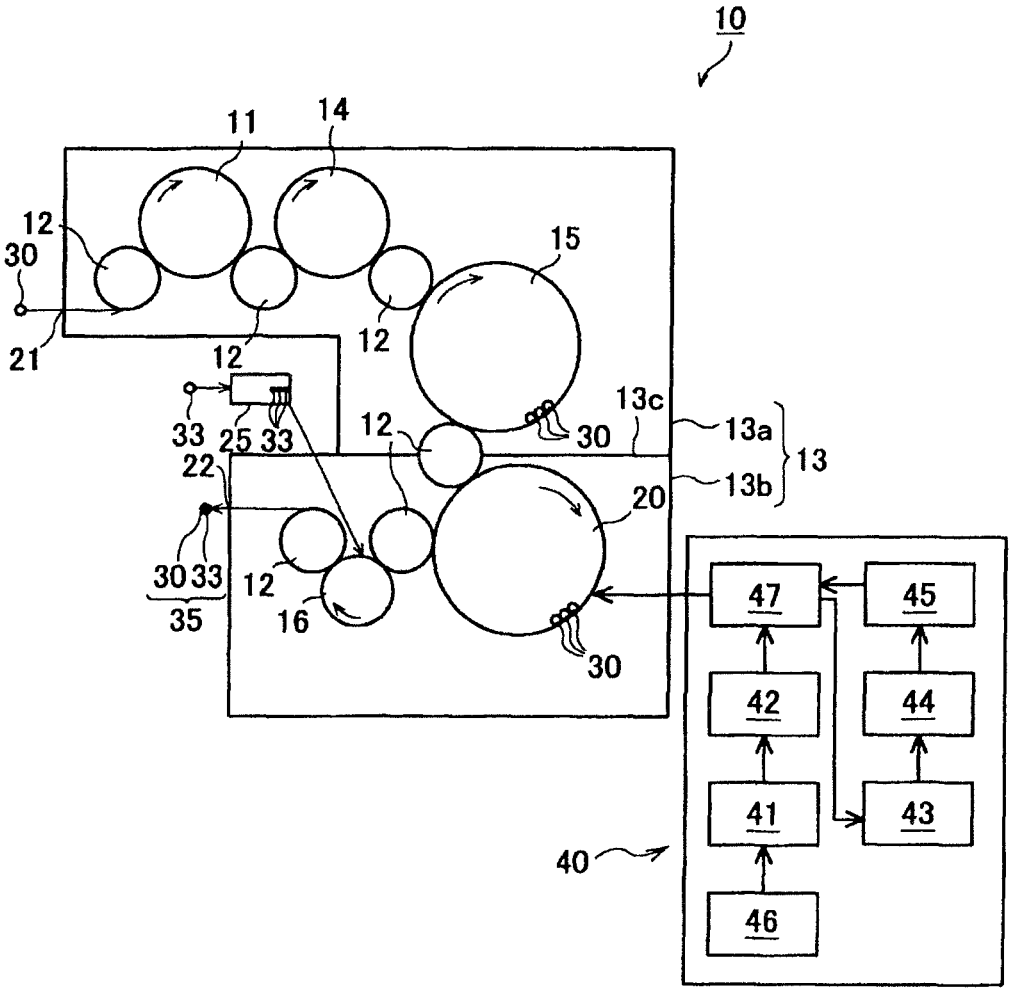
FIG. 1 is a schematic plan view showing a beverage aseptic filling system according to one embodiment of the present invention.
Figure 2:
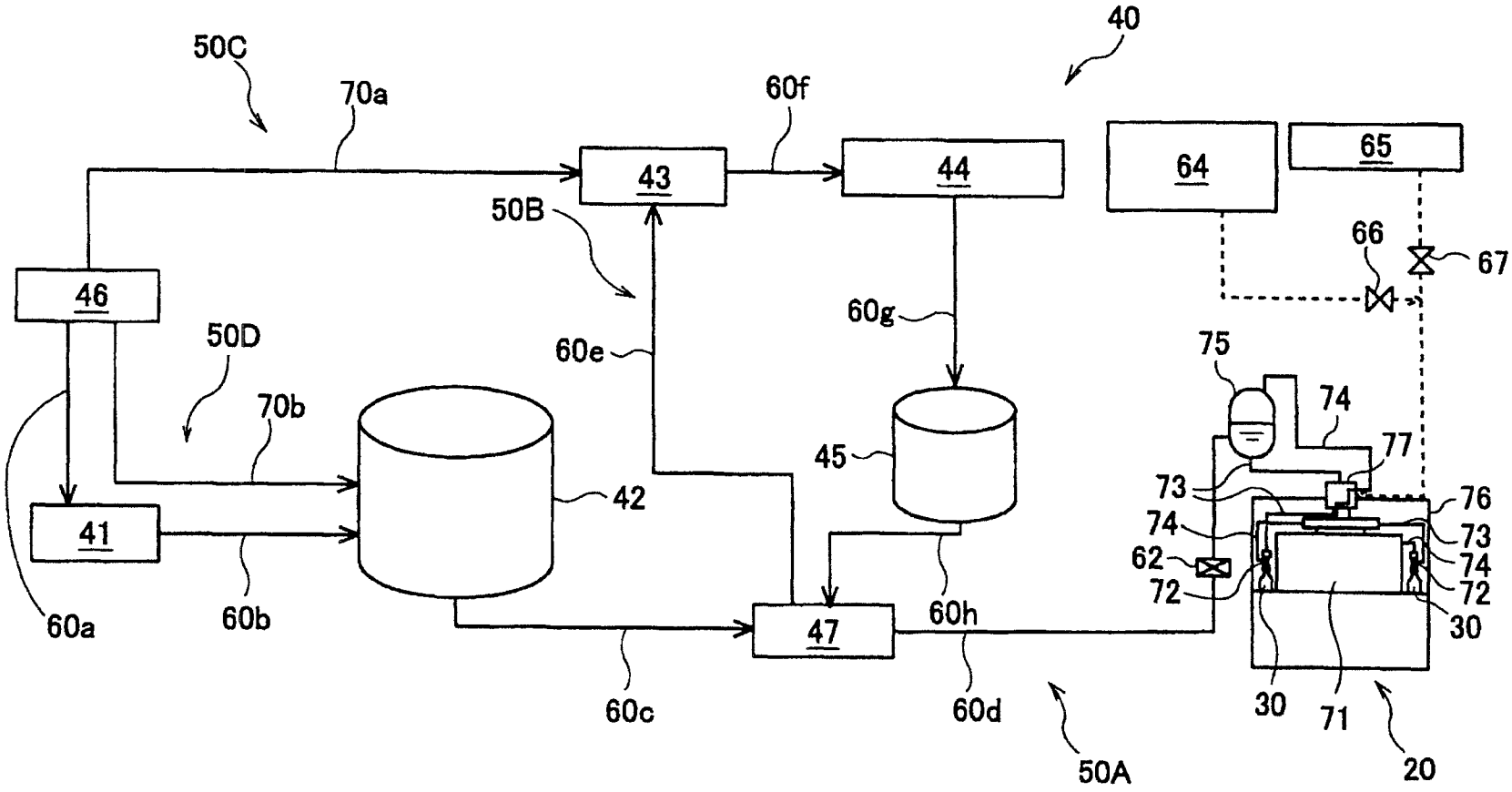
FIG. 2 is a schematic configuration diagram showing a beverage preparation unit and a beverage filling unit in the beverage aseptic filling system according to one embodiment of the present invention.
Figure 3:
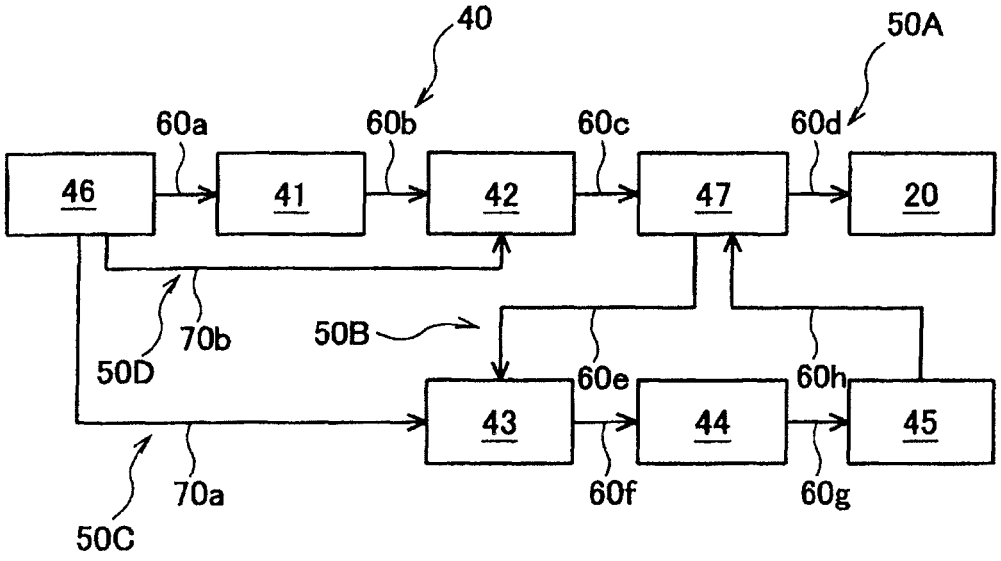
FIG. 3 is a schematic block diagram showing flow of a beverage in the beverage preparation unit and the beverage filling unit in the beverage aseptic filling system according to one embodiment of the present invention.

Hereinafter, an embodiment of the present invention will be described with reference to FIGS. 1 to 3. FIGS. 1 to 3 illustrate one embodiment of the present invention. Note that, in the drawings below, the same reference numerals are given to the same parts, and a part of the detailed description may be omitted.

(Beverage Aseptic Filling System)

First, a beverage aseptic filling system according to the present embodiment will be described with reference to FIG. 1.

A beverage aseptic filling system 10 shown in FIG. 1 is a system for both a carbonated beverage and a non-carbonated beverage, that is, a filling system that can fill a bottle (container) 30 with both a beverage including a carbonated beverage and a beverage including a non-carbonated beverage selectively. Further, the beverage aseptic filling system 10 is a system for both a sterilized carbonated beverage for which sterilization treatment is performed and a non-sterilized carbonated beverage, that is, a filling system that can fill the bottle (container) 30 with both a beverage including a sterilized carbonated beverage and a beverage including a non-sterilized carbonated beverage selectively. The bottle 30 can be made by performing biaxial stretching blow molding on a preform made by performing injection molding on a synthetic resin material. A material of the bottle 30 to be used is preferably a thermoplastic resin such as polyethylene (PE), polypropylene (PP), polyethylene-terephthalate (PET), or polyethylene naphthalate (PEN). In addition, as a container, glass, a can, or the like may be used. The present embodiment will describe an example of a case where a plastic bottle is used for the container.

As shown in FIG. 1, the beverage aseptic filling system 10 includes a bottle feeding portion 21, a bottle sterilization unit 11, an air rinse unit 14, a sterile water rinse unit 15, a beverage filling unit (filler) 20, a cap attachment unit (a capper, a seamer, and a capping machine) 16, and a product bottle conveyor 22. These bottle feeding portion 21, bottle sterilization unit 11, air rinse unit 14, sterile water rinse unit 15, beverage filling unit 20, cap attachment unit 16, and product bottle conveyor 22 are disposed in this order along a conveying direction of the bottle 30 from an upstream side to a downstream side. Further, between the bottle sterilization unit 11, the air rinse unit 14, the sterile water rinse unit 15, the beverage filling unit 20, and the cap attachment unit 16, a plurality of convey wheels 12 for conveying the bottle 30 between these devices is provided.

The bottle feeding portion 21 successively receives the empty bottle 30 from an outside to the beverage aseptic filling system 10, and conveys the received bottle 30 to the bottle sterilization unit 11.

A bottle molding portion (not shown) which molds the bottle 30 by performing biaxial stretching blow molding on a preform may be provided on the upstream side of the bottle feeding portion 21. As described above, the process starting upon feeding of the preform, and then molding of the bottle 30, and ending upon filling of the bottle 30 with the beverage and capping may be performed continuously. In this case, since the beverage can be transported from the outside to the beverage aseptic filling system 10 in the form of a preform having small volume instead of the bottle 30 having large volume, a facility constituting the beverage aseptic filling system 10 can be made compact.

The bottle sterilization unit 11 sterilizes the inside of the bottle 30 by injecting a disinfectant into the bottle 30. As the disinfectant, a hydrogen peroxide aqueous solution is used, for example. In the bottle sterilization unit 11, mist or gas obtained by temporarily vaporizing and then condensing a hydrogen peroxide solution having a concentration of 1% by weight or more, preferably 35% by weight, is generated, and the mist or gas is sprayed to inner and outer surface of the bottle 30. Since the inside of the bottle 30 is thus sterilized by the mist or gas of the hydrogen peroxide aqueous solution, the inner surface of the bottle 30 is sterilized uniformly.

The air rinse unit 14 supplies sterile heated air or room temperature air into the bottle 30 to remove foreign matter, hydrogen peroxide, and the like from the inside of the bottle 30 while activating the hydrogen peroxide.

The sterile water rinse unit 15 washes the bottle 30, sterilized by hydrogen peroxide as a disinfectant, with sterilized water at 15° C. or more to 85° C. or less. As a result, hydrogen peroxide adhering to the bottle 30 is washed off, and foreign matter is removed. Note that the sterile water rinse unit 15 is not necessarily provided.

The beverage filling unit 20 fills the bottle 30 with a sterilized carbonated beverage or a sterilized non-carbonated beverage for which sterilization treatment is performed in advance, or a non-sterilized carbonated beverage that does not require sterilization treatment (hereinafter simply referred to as "beverage"), from a mouth of the bottle 30. The beverage filling unit 20 fills the bottle 30 in an empty state with a beverage. In the beverage filling unit 20, while a plurality of the bottles 30 is rotated (revolved), the inside of the bottles 30 is filled with a beverage.

In a case where a beverage with which the bottle 30 is filled is a carbonated beverage (sterilized carbonated beverage or non-sterilized carbonated beverage), the bottle 30 is filled with the beverage at a filling temperature of 1° C. or more and 40° C. or less, preferably 5° C. or more and 10° C. or less. The reason for setting the filling temperature of the carbonated beverage to, for example, 1° C. or more and 10° C. or less is that carbon dioxide gas is easily released from the carbonated beverage when the liquid temperature of the carbonated beverage exceeds 10° C. Note that, as a carbonated beverage with which the beverage filling unit 20 is filled, a carbonated beverage (sterilized carbonated beverage) containing a component derived from an animal or a plant, such as fruit juice and a milk component, or a carbonated beverage (non-sterilized carbonated beverage) containing no component derived from an animal or a plant, such as soda, cola, and the like, can be used.

When the beverage with which the bottle 30 is filled is a sterilized non-carbonated beverage, the bottle 30 is filled with the beverage at a filling temperature of 1° C. or more and 40° C. or less, preferably 10° C. or more and 30° C. or less. Note that, as a sterilized non-carbonated beverage with which the beverage filling unit 20 fills a bottle, a non-carbonated beverage containing a component derived from an animal or a plant, such as fruit juice and a milk component, can be used.

The beverage supplied to the beverage filling unit 20 is prepared by a beverage preparation unit 40 in advance. The beverage filling unit 20 fills the inside of the bottle 30 with a beverage sent from the beverage preparation unit 40. Note that a configuration of the beverage preparation unit 40 will be described later.

The cap attachment unit 16 caps the bottle 30 by attaching a cap 33 to the mouth of the bottle 30. In the cap attachment unit 16, the mouth of the bottle 30 is capped with the cap 33 and then sealed so as to prevent external air or microorganisms from invading into the bottle 30. In the cap attachment unit 16, while a plurality of the bottles 30 filled with the beverage rotates (revolves), the caps 33 are attached to the mouths of the bottles 30. In this manner, by attaching the cap 33 to the mouth of the bottle 30, it is possible to obtain a product bottle 35.

The cap 33 is sterilized by a cap sterilization unit 25 in advance. The cap sterilization unit 25 is disposed outside a sterile chamber 13 (to be described later) and near the cap attachment unit 16, for example. In the cap sterilization unit 25, a large number of the caps 33 carried in from the outside are collected in advance and then conveyed in a row toward the cap attachment unit 16. Mist or gas of hydrogen peroxide is blown against an inner and outer surfaces of the cap 33 on the way of conveyance of the cap 33 toward the cap attachment unit 16 and then dried with hot air and sterilized.

The product bottle conveyor 22 continuously conveys the product bottle 35 with the cap 33 attached by the cap attachment unit 16 to the outside of the beverage aseptic filling system 10.

Note that the beverage aseptic filling system 10 includes the sterile chamber 13. Inside the sterile chamber 13, the above-mentioned bottle sterilization unit 11, air rinse unit 14, sterile water rinse unit 15, beverage filling unit 20, and cap attachment unit 16 are accommodated. The inside of the sterile chamber 13 is kept in a sterile state.

Furthermore, the sterile chamber 13 is divided into a bottle sterilization chamber 13*a* and a filling and seaming chamber 13*b*. A chamber wall 13*c* is provided between the bottle sterilization chamber 13*a* and the filling and seaming chamber 13*b*, and the bottle sterilization chamber 13*a* and the filling and seaming chamber 13*b* are separated from each other with the chamber wall 13*c* interposed between them. Inside the bottle sterilization chamber 13*a*, the bottle sterilization unit 11, the air rinse unit 14, and the sterile water rinse unit 15 are disposed. Further, the beverage filling unit 20 and the cap attachment unit 16 are disposed inside the filling and seaming chamber 13*b*.

(Beverage Aseptic Filling System)

Next, a configuration of the beverage preparation unit 40 and the beverage filling unit 20 of the beverage aseptic filling system 10 will be described using FIGS. 2 and 3. FIG. 2 is a diagram showing the configuration of the beverage preparation unit 40 and the beverage filling unit 20, and FIG. 3 is a block diagram schematically showing the configuration shown in FIG. 2. Note that, in FIG. 2, a solid arrow indicates a process of the beverage (a raw material liquid, a sterilized beverage, a non-sterilized beverage, a sterilized carbonated beverage, a sterilized non-carbonated beverage, or a non-sterilized carbonated beverage), a dotted arrow indicates a process of gas (vapor, sterile carbon dioxide gas), and a dashed-dotted arrow indicates a process of water (sterile water).

As shown in FIGS. 2 and 3, the beverage preparation unit 40 includes a raw material liquid preparation unit 46, a beverage sterilization unit 41, a first aseptic tank 42, a switching valve 47, a beverage cooling unit 43, a carbonated beverage production unit 44, and a second aseptic tank 45.

Further, the raw material liquid preparation unit 46, the beverage sterilization unit 41, the first aseptic tank 42, the switching valve 47, the beverage cooling unit 43, the carbonated beverage production unit 44, the second aseptic tank 45, and the beverage filling unit 20 are connected by eight beverage supply system pipes 60*a* to 60*h*. Beverages (raw material liquids, sterilized beverages, non-sterilized beverages, sterilized carbonated beverages, sterilized non-carbonated beverages, or non-sterilized carbonated beverages) sequentially pass through the inside of the eight beverage supply system pipes 60*a* to 60*h*.

The raw material liquid preparation unit 46 prepares a raw material liquid from a beverage raw material. Here, the beverage raw material includes a sweetener, fruit juice, a plant extract, a dairy product, a flavor, a sourness modifier, vitamins, and the like. Further, the beverage may be prepared, for example, by mixing one or more of the above-mentioned beverage raw materials with beverage water at a predetermined ratio.

The raw material liquid preparation unit 46 is connected to the beverage sterilization unit 41 via the first beverage supply system pipe 60*a*. A raw material liquid prepared in the raw material liquid preparation unit 46 is supplied to the beverage sterilization unit 41. Then, the beverage sterilization unit 41 produces a sterilized beverage by sterilizing the supplied raw material liquid. The beverage sterilization unit 41 may be constituted by, for example, an ultra high-temperature (UHT) sterilizer. In this case, the raw material liquid is supplied from the raw material liquid preparation unit 46 to the beverage sterilization unit 41 constituted by a UHT sterilizer, and the raw material liquid is instantaneously heated and sterilized to produce a sterilized beverage.

Further, the raw material liquid preparation unit 46 is connected to the beverage cooling unit 43 by a first bypass filling line (third filling line) 50C. The first bypass filling line 50C is a supply path for directly feeding the raw material liquid from the raw material liquid preparation unit 46 to the beverage cooling unit 43 without using the beverage sterilization unit 41, the first aseptic tank 42, and the switching valve 47. The first bypass filling line 50C has a first beverage supply system bypass pipe 70*a* through which the beverage (raw material liquid) passes. Note that the first beverage supply system bypass pipe 70*a* may be provided with a pump (not shown) for feeding the raw material liquid from the raw material liquid preparation unit 46.

For example, in a case where the beverage with which the bottle 30 is filled by the beverage filling unit 20 is a non-sterilized carbonated beverage, a non-sterilized beverage (raw material liquid) from the raw material liquid preparation unit 46 can be supplied to the beverage cooling unit 43 via the first bypass filling line 50C. That is, the non-sterilized beverage (raw material liquid) prepared in the raw material liquid preparation unit 46 is directly sent to the beverage cooling unit 43. Next, in the beverage cooling unit 43, the raw material liquid is cooled to, for example, 1° C. or more and 5° C. or less, and then, in the carbonated beverage production unit 44, carbon dioxide gas is injected into the beverage cooled by the beverage cooling unit 43, and a carbonated beverage is manufactured.

Furthermore, the raw material liquid preparation unit 46 is connected to the first aseptic tank 42 by a second bypass filling line (fourth filling line) 50D. The second bypass filling line 50D is a supply path for directly feeding the raw material liquid from the raw material liquid preparation unit 46 to the first aseptic tank 42 without using the beverage sterilization unit 41. The second bypass filling line 50D has a second beverage supply system bypass pipe 70*b* through which the beverage (raw material liquid) passes. Note that the second beverage supply system bypass pipe 70*b* may be provided with a pump (not shown) for feeding the raw material liquid from the raw material liquid preparation unit 46.

For example, in a case where the beverage with which the bottle 30 is filled by the beverage filling unit 20 is a non-sterilized carbonated beverage, a non-sterilized beverage (raw material liquid) from the raw material liquid preparation unit 46 can be supplied to the first aseptic tank 42 via the second bypass filling line 50D. That is, the non-sterilized beverage (raw material liquid) prepared in the raw material liquid preparation unit 46 is directly sent to the first aseptic tank 42. Such non-sterilized carbonated beverages include a carbonated beverage which does not require sterilization, such as soda and cola.

Note that, in the present embodiment, although both the first bypass filling line 50C and the second bypass filling line 50D are provided, the present invention is not limited to this configuration, and the configuration may be such that only either one of the first bypass filling line 50C and the second bypass filling line 50D is provided.

The beverage sterilization unit 41 is connected to the first aseptic tank 42 via the second beverage supply system pipe 60*b*. The first aseptic tank 42 is supplied with the sterilized beverage sterilized in the beverage sterilization unit 41. Alternatively, the non-sterilized beverage from the second bypass filling line 50D is supplied to the first aseptic tank 42 without passing through the beverage sterilization unit 41. The first aseptic tank 42 temporarily stores the sterilized beverage sterilized by the beverage sterilization unit 41 or the non-sterilized beverage from the second bypass filling line 50D. Sterile air is supplied from an aseptic air supply unit (not shown) to the first aseptic tank 42, and the first aseptic tank 42 is filled with the sterile air. Note that the first aseptic tank 42 does not need to be provided, and the sterilized beverage from the beverage sterilization unit 41 or the non-sterilized beverage from the second bypass filling line 50D may be directly supplied to the switching valve 47.

The first aseptic tank 42 is connected to the switching valve 47 via the third beverage supply system pipe 60*c*. The switching valve 47 is supplied with the sterilized beverage or the non-sterilized beverage from the first aseptic tank 42.

The switching valve 47 feeds the sterilized beverage or non-sterilized beverage sent from the first aseptic tank 42 by switching between a first filling line 50A used for both a carbonated beverage and a non-carbonated beverage and a second filling line 50B exclusively used for a carbonated beverage. That is, the switching valve 47 supplies the sterilized beverage or non-sterilized beverage sent from the first aseptic tank 42 toward either one of the first filling line 50A positioned on the beverage filling unit 20 side and the second filling line 50B positioned on the beverage cooling unit 43 side selectively. As the switching valve 47, for example, a valve manifold can be used. Further, the switching valve 47 may be controlled by a control signal from a control unit (not shown) of the beverage aseptic filling system 10 so that the first filling line 50A and the second filling line 50B can be switched to each other. Alternatively, the first filling line 50A and the second filling line 50B may be switched by manual operation of the switching valve 47.

Furthermore, a return line (the eighth beverage supply system pipe 60*h*) from the second filling line 50B is connected to the switching valve 47. That is, in a case where the sterilized beverage or the non-sterilized beverage from the first aseptic tank 42 is supplied to the second filling line 50B, the switching valve 47 also plays a role of supplying a sterilized carbonated beverage or a non-sterilized carbonated beverage from the second filling line 50B (the eighth beverage supply system pipe 60*h*) to the beverage filling unit 20 side. However, the present invention is not limited to the above, and the configuration may be such that a separate valve is provided on a downstream side (the fourth beverage supply system pipe 60*d*) of the switching valve 47, and the return line (the eighth beverage supply system pipe 60*h*) from the second filling line 50B is connected to the separate valve. Alternatively, the return line (the eighth beverage supply system pipe 60*h*) from the second filling line 50B may be directly connected to the beverage filling unit 20. Note that the details of the first filling line 50A and the second filling line 50B will be described later.

An outlet on the second filling line 50B side of the switching valve 47 is connected to the beverage cooling unit 43 via the fifth beverage supply system pipe 60*e*. In a case where the switching valve 47 is switched to the second filling line 50B side, the sterilized beverage or the non-sterilized beverage that is sterilized by the beverage sterilization unit 41 and sent from the first aseptic tank 42 is supplied to the beverage cooling unit 43. Alternatively, the non-sterilized beverage from the first bypass filling line 50C is supplied to the beverage cooling unit 43 without passing through the beverage sterilization unit 41. The beverage cooling unit 43 cools the sterilized beverage or the non-sterilized beverage. The beverage cooling unit 43 has a cooling plate or a cooling shell and a tube. In the beverage cooling unit 43, the sterilized beverage or non-sterilized beverage is cooled to, for example, 1° C. or more and 10° C. or less, preferably 1° C. or more and 5° C. or less. In this manner, the carbonated beverage production unit 44 facilitates dissolving of the carbon dioxide gas in the sterilized beverage or the non-sterilized beverage.

The beverage cooling unit 43 is connected to the carbonated beverage production unit 44 via the sixth beverage supply system pipe 60*f*. The sterilized beverage or the non-sterilized beverage from the beverage cooling unit 43 is supplied to the carbonated beverage production unit 44.

The carbonated beverage production unit 44 injects carbon dioxide gas into the sterilized beverage or the non-sterilized beverage cooled by the beverage cooling unit 43 to dissolve the carbon dioxide gas in the sterilized beverage or the non-sterilized beverage, so as to produce a sterilized carbonated beverage or a non-sterilized carbonated beverage. For the carbonated beverage production unit 44, for example, a publicly-known mechanism, such as a carbonator, can be used. In the carbonated beverage production unit 44, carbon dioxide gas is introduced into the sterilized beverage or non-sterilized beverage under high pressure, and a sterilized carbonated beverage or non-sterilized carbonated beverage in which the carbon dioxide gas is dissolved is produced.

The carbonated beverage production unit 44 is connected to the second aseptic tank 45 via the seventh beverage supply system pipe 60*g*. The sterilized carbonated beverage or non-sterilized carbonated beverage from the carbonated beverage production unit 44 is supplied to the second aseptic tank 45.

The second aseptic tank 45 temporarily stores the sterilized carbonated beverage or the non-sterilized carbonated beverage in which the carbon dioxide gas is dissolved in the carbonated beverage production unit 44. Sterile carbon dioxide gas is supplied to the second aseptic tank 45, and the second aseptic tank 45 is filled with the sterile carbon dioxide gas. By pressurizing the sterilized carbonated beverage or the non-sterilized carbonated beverage with sterile carbon dioxide gas, the carbon dioxide gas dissolved in the sterilized carbonated beverage or the non-sterilized carbonated beverage is prevented from being released into a gas phase. The second aseptic tank 45 is preferably pressurized at a pressure higher than a carbon dioxide gas pressure of the product standard. In this manner, a concentration of the carbon dioxide gas in the sterilized carbonated beverage or non-sterilized carbonated beverage is kept constant. Note that the second aseptic tank 45 does not need to be provided, and the sterilized carbonated beverage or non-sterilized carbonated beverage from the carbonated beverage production unit 44 may be directly supplied to the switching valve 47 or a filling head tank 75 of the beverage filling unit 20.

The second aseptic tank 45 is connected to the switching valve 47 via the eighth beverage supply system pipe 60*h*. The sterilized carbonated beverage or non-sterilized carbonated beverage from the second aseptic tank 45 is supplied to the switching valve 47. Further, a filter 62 is interposed in the fourth beverage supply system pipe 60*d* between the switching valve 47 and the filling head tank 75 of the beverage filling unit 20. The filter 62 filters out impurities, foreign matters, and the like contained in the beverage sent from the switching valve 47 to the filling head tank 75. Note that the filter 62 may be provided anywhere on the pipe up to the tip of a filling valve.

The filling head tank (buffer tank) 75 is disposed in an upper portion of the beverage filling unit 20. The filling head tank 75 is filled with a beverage. In a case where the inside of the filling head tank 75 is filled with a sterilized carbonated beverage or a non-sterilized carbonated beverage, the filling head tank 75 is supplied with carbon dioxide gas in a sterile state. By pressurizing the sterilized carbonated beverage or the non-sterilized carbonated beverage with the sterile carbon dioxide gas, the carbon dioxide gas dissolved in the sterilized carbonated beverage or the non-sterilized carbonated beverage is prevented from being released into a gas phase. The filling head tank 75 is preferably pressurized at a pressure higher than a carbon dioxide gas pressure of the product standard. In this manner, a concentration of the carbon dioxide gas in the carbonated beverage in the filling head tank 75 is kept constant.

In the beverage filling unit 20, the bottle 30 in an empty state is filled with the beverage with which the filling head tank 75 is filled. The beverage filling unit 20 has a convey wheel 71 that rotates. While the convey wheel 71 rotates (revolves) a plurality of the bottles 30, the inside of the bottles 30 is filled with the beverage. Further, a plurality of filling nozzles 72 is disposed along an outer circumference of the convey wheel 71. One of the bottle 30 is attached to each of the filling nozzles 72, and the filling nozzle 72 injects the beverage into the bottle 30. As the filling nozzle 72, a publicly-known one can be used (for example, JP 4674743 B2). A beverage supply line 73 and a gas supply line 74 are connected to the filling nozzle 72. Among the above, the beverage supply line 73 has one end connected to the filling head tank 75 filled with the beverage, and communicates with the inside of the bottle 30 at the other end. Then, the beverage supplied from the filling head tank 75 passes through the beverage supply line 73 and is injected into the bottle 30. Further, the gas supply line 74 has one end connected to the filling head tank 75, and communicates with the inside of the bottle 30 at the other end.

In a case where a bottle is to be filled with a sterilized carbonated beverage or a non-sterilized carbonated beverage, a counter pressure gas made from sterile carbon dioxide gas supplied from the filling head tank 75 passes through the gas supply line 74 and is put into the inside of the bottle 30. Furthermore, separately from the gas supply line 74, a snift line (not shown) is connected to each filling valve (not shown), and the gas inside the bottle 30 can be discharged through the snift line. The snift line of each filling valve is connected by a manifold, and has the tip that is opened into a filler in the sterile chamber 13. In this manner, the gas in the bottle 30 can be discharged into the filler which is sterile space without contamination of bacteria. Note that, when a non-sterilized beverage is produced, a product liquid route, an air route, a carbon dioxide gas route, and the like do not need to be sterilized (sterilization), but may be sterilized.

The convey wheel 71 and the filling nozzle 72 are covered with a cover 76. A rotary joint (rotating machine) 77 is attached to the top of the cover 76. The rotary joint (the convey wheel 71, the filling nozzle 72, and the like) and a non-rotating body (the cover 76 and the like) are sealed in a sterile state by the rotary joint 77. The rotary joint 77 is connected to a sterilizing gas supply unit 64 for pipe sterilization and a sterile air supply unit 65. Valves 66 and 67 are provided in a supply pipe from the sterilizing gas supply unit 64 and a supply pipe from the sterile air supply unit 65, respectively. The sterilizing gas supplied from the sterilizing gas supply unit 64 includes, for example, hydrogen peroxide gas and steam. The sterile air supply unit 65 supplies sterile air toward the rotary joint 77 after the supply pipe is sterilized by the sterilizing gas from the sterilizing gas supply unit 64. The sterile air from the sterile air supply unit 65 is used for a mechanical seal of the rotary joint 77. As described above, by supplying sterile air to the space surrounding a boundary surface of the mechanical seal, it is possible to prevent bacteria and microorganisms from the outside from being mixed into the beverage through the boundary surface. Note that, when a non-sterilized beverage is produced, the rotary joint 77 does not need to be sterilized (sterilization), but may be sterilized.

As described above, the raw material liquid preparation unit 46, the beverage sterilization unit 41, the first aseptic tank 42, the switching valve 47, the beverage cooling unit 43, the carbonated beverage production unit 44, the second aseptic tank 45, and the beverage filling unit 20 are connected by the eight beverage supply system pipes 60*a* to 60*h*. Beverages pass sequentially through the inside of the eight beverage supply system pipes 60*a* to 60*h*. In this case, the sterilization degree of the inside of the switching valve 47, the beverage cooling unit 43, the carbonated beverage production unit 44, the beverage filling unit 20, and the seven beverage supply system pipes 60*b* to 60*h* is higher than the sterilization degree of the sterilized beverage after sterilization in the beverage sterilization unit 41. In this manner, in a process after the beverage sterilization unit 41, the sterilization degree of the beverage can be maintained to be higher than the sterilization degree of the sterilized beverage after sterilization in the beverage sterilization unit 41. As a result, even in a case where the bottle 30 is filled with a beverage containing a component derived from an animal or a plant, such as fruit juice and a milk component, it is possible to reliably prevent proliferation of mold, yeast, and other microorganisms in the beverage after filling.

Next, the first filling line 50A and the second filling line 50B described above will be further described.

As described above, the first filling line 50A is interposed between the switching valve 47 and the beverage filling unit 20. In this case, the first filling line 50A includes the fourth beverage supply system pipe 60*d*, and the filter 62 is disposed in the fourth beverage supply system pipe 60*d* that constitutes the first filling line 50A. The sterilized carbonated beverage, non-sterilized carbonated beverage, or sterilized non-carbonated beverage from the switching valve 47 pass through the first filling line 50A. Specifically, in a case where the beverage with which the bottle 30 is filled by the beverage filling unit 20 is a non-carbonated beverage, the switching valve 47 directly connects the third beverage supply system pipe 60*c* and the fourth beverage supply system pipe 60*d*. In this case, the sterilized non-carbonated beverage consisting of the sterilized beverage from the switching valve 47 is supplied to the beverage filling unit 20 via the first filling line 50A without passing through the second filling line 50B. On the other hand, in a case where the beverage with which the bottle 30 is filled by the beverage filling unit 20 is a sterilized carbonated beverage or a non-sterilized carbonated beverage, the switching valve 47 connects the third beverage supply system pipe 60*c* and the fifth beverage supply system pipe 60*e*, and also connects the eighth beverage supply system pipe 60*h* and the fourth beverage supply system pipe 60*d*. In this case, the sterilized beverage or the non-sterilized beverage sent from the switching valve 47 to the second filling line 50B becomes a sterilized carbonated beverage or a non-sterilized carbonated beverage in the carbonated beverage production unit 44. This sterilized carbonated beverage or non-sterilized carbonated beverage passes through the switching valve 47 again and is supplied to the beverage filling unit 20 via the first filling line 50A.

Further, the second filling line 50B is configured in a loop, and both ends of the loop are connected to the switching valve 47. The second filling line 50B includes the four beverage supply system pipes 60*e* to 60*h*. A beverage cooling unit 43, the carbonated beverage production unit 44, and the second aseptic tank 45 are disposed in the second filling line 50B.

Note that, for a channel through which a beverage passes in the beverage filling unit 20 and the beverage preparation unit 40, cleaning in place (CIP) processing is performed periodically or at the time of switching a type of a beverage, and sterilizing in place (SIP) processing is preferably further performed. In the CIP processing, for example, a cleaning solution obtained by adding an alkaline agent, such as caustic soda, to water is caused to flow through a channel from the inside of a pipeline of a path for supplying the beverage raw material to the raw material liquid preparation unit 46 to the filling nozzle 72 of the beverage filling unit 20, and then a cleaning solution obtained by adding an acidic agent to water is caused to flow. In this manner, a residue and the like of a previous beverage adhering in a channel through which a beverage passes are removed. Further, the SIP processing is processing for sterilizing the inside of a channel through which the beverage passes in advance before the filling operation of the beverage is performed, and, for example, heating steam or hot water is caused to flow into the channel cleaned by the CIP. In this manner, the inside of the channel through which the beverage passes is sterilized and becomes in a sterile state.

The degree of sterilization of the channel through which the beverage of the beverage filling unit 20 and the beverage preparation unit 40 passes may be controlled by an F value. For example, while heating steam or hot water is caused to flow through the channel of the beverage filling unit 20 and the beverage preparation unit 40, the temperature may be measured by temperature sensors disposed at various places in the channel where temperature does not easily rise. Then, when the time in which the temperature from each temperature sensor reaches a predetermined temperature becomes equal to or longer than a predetermined time, the heating of the channel by the heating steam or the like may be finished. Here, the F value is a heating time required to kill all bacteria when the bacteria are heated for a certain period of time, and is indicated by a lethal time of the bacteria at 121.1° C., and is calculated by the equation below.

$$F=\int_{t_0}^{t_1}10^{(T-T_r)/Z}dt \quad \text{Equation 1}$$

(where T is an optional sterilization temperature (° C.), 10^{(T−Tr)/Z} is a lethality at the optional sterilization temperature T, Tr is a reference temperature (° C.), and Z is a Z value (° C.).)

(Beverage filling method)

Next, a beverage filling method using the above-described beverage aseptic filling system 10 (FIG. 1) will be described. Note that, in the description below, a filling method at a normal time, that is, a beverage filling method in which the bottle 30 is filled with a beverage to produce the product bottle 35 will be described.

First, a plurality of the empty bottles 30 is sequentially fed from the outside of the beverage aseptic filling system 10 to the bottle feeding portion 21. The bottle 30 is sent from the bottle feeding portion 21 to the bottle sterilization unit 11 by the convey wheel 12 (container feeding process).

Next, in the bottle sterilization unit 11, the bottle 30 is sterilized using a hydrogen peroxide aqueous solution as a disinfectant (sterilization process). At this time, the hydrogen peroxide aqueous solution is gas or mist which is obtained by temporarily vaporizing and then condensing the hydrogen peroxide aqueous solution having a concentration of 1% by weight or more, preferably 35% by weight, and the gas or mist is supplied toward the bottle 30.

Subsequently, the bottle 30 is sent to the air rinse unit 14 by the convey wheel 12, and sterile heated air or room temperature air is supplied in the air rinse unit 14, whereby foreign matter, hydrogen peroxide, and the like are removed from the bottle 30 while hydrogen peroxide is activated. Subsequently, the bottle 30 is conveyed to the sterile water rinse unit 15 by the convey wheel 12. In the sterile water rinse unit 15, cleaning with sterile water at 15° C. or more and 85° C. or less is performed (rinsing process). Specifically, sterile water at 15° C. or more and 85° C. or less is supplied into the bottle 30 at a flow rate of 5 L/min or more and 15 L/min or less. At this time, it is preferable that the bottle 30 take an inverted attitude, and the sterile water is supplied into the bottle 30 through the downwardly opened mouth, and flows out of the bottle 30 from the mouth. With this sterile water, hydrogen peroxide adhering to the bottle 30 is washed off, and foreign matter is removed. Note that, the process in which sterile water is supplied into the bottle 30 does not need to be provided.

Subsequently, the bottle 30 is conveyed to the beverage filling unit 20 by the convey wheel 12. In the beverage filling unit 20, while the bottle 30 is rotated (revolution), the bottle 30 is filled with the beverage (sterilized carbonated beverage, non-sterilized carbonated beverage or sterilized non-carbonated beverage) from the mouth of the bottle 30 (filling process). In a case where the beverage to be filled with is a sterilized carbonated beverage or a non-sterilized carbonated beverage, in the beverage filling unit 20, the sterilized bottle 30 is filled with the sterilized carbonated beverage or the non-sterilized carbonated beverage prepared in advance by the beverage preparation unit 40 at a filling temperature of 1° C. or more and 40° C. or less, preferably 5° C. or more and 10° C. or less. On the other hand, in a case where the beverage to be filled with is a sterilized non-carbonated beverage, in the beverage filling unit 20, the sterilized bottle 30 is filled with the sterilized non-carbonated beverage prepared in advance by the beverage preparation unit 40 at a filling temperature of 1° C. or more and 40° C. or less, preferably 10° C. or more and 30° C. or less.

Next, processes of producing a beverage in the beverage preparation unit 40 and supplying the beverage to the beverage filling unit 20 will be described with reference to FIGS. 2 and 3. Hereinafter, a case of producing a sterilized carbonated beverage, a case of producing a non-sterilized carbonated beverage, and a case of producing a sterilized non-carbonated beverage will be described in this order.

(Case of Sterilized Carbonated Beverage)

First, a case where a sterilized carbonated beverage is produced by the beverage preparation unit 40 and the bottle 30 is filled with the sterilized carbonated beverage by the beverage filling unit 20 will be described.

First, in the raw material liquid preparation unit 46, the raw material liquid is prepared from the beverage raw material. Next, for example, in the beverage sterilization unit 41 formed of an ultra-high temperature (UHT) sterilizer, the raw material liquid sent from the raw material liquid preparation unit 46 is sterilized, so that a sterilized beverage is produced (sterilization process). During this time, the raw material liquid is supplied from the raw material liquid preparation unit 46 to the beverage sterilization unit 41, and the raw material liquid is instantaneously heated and sterilized to obtain a sterilized beverage.

The sterilized beverage sterilized by the beverage sterilization unit 41 is sent to the first aseptic tank 42, and temporarily stored in the first aseptic tank 42 (first storage process). Next, the sterilized beverage from the first aseptic tank 42 is sent to the beverage cooling unit 43 via the switching valve 47. Note that the switching valve 47 is switched in advance so as to send the sterilized beverage to the second filling line 50B side. Next, in the beverage cooling unit 43, the sterilized beverage produced in the beverage sterilization unit 41 is cooled to, for example, 1° C. or more and 5° C. or less (cooling process).

The sterilized beverage cooled by the beverage cooling unit 43 is sent to a carbonated beverage production unit 44 such as a carbonator. In the carbonated beverage production unit 44, carbon dioxide gas is injected into the sterilized beverage cooled by the beverage cooling unit 43, and a sterilized carbonated beverage is produced (carbonated beverage producing process).

Next, the sterilized carbonated beverage from the carbonated beverage production unit 44 is sent to the second aseptic tank 45. The sterilized carbonated beverage sent to the second aseptic tank 45 is temporarily stored in the second aseptic tank 45 (second storage process). Next, the sterilized carbonated beverage from the second aseptic tank 45 is sent to the first filling line 50A side via the switching valve 47 and is fed to the filling head tank 75 of the beverage filling unit 20. The sterilized carbonated beverage sent to the filling head tank 75 is temporarily stored in the filling head tank 75 (third storage process).

Note that, when the beverage (raw material liquid, sterilized beverage, or sterilized carbonated beverage) is sent from the raw material liquid preparation unit 46 to the beverage filling unit 20 via the beverage sterilization unit 41, the first aseptic tank 42, the switching valve 47, the beverage cooling unit 43, the carbonated beverage production unit 44, the second aseptic tank 45, and the switching valve 47 sequentially, the beverage passes through the eight beverage supply system pipes 60*a* to 60*h* sequentially.

After the above, in the beverage filling unit 20, the bottle 30 in an empty state is filled with the sterilized carbonated beverage stored in the filling head tank 75.

During this time, first in the beverage filling unit 20, the filling nozzles 72 is closely adhere to the mouth of the bottle 30, so that the gas supply line 74 and the bottle 30 communicate with each other. Next, sterile carbon dioxide gas for counter pressure is supplied from the filling head tank 75 to the inside of the bottle 30 through the gas supply line 74. Thus, an inner pressure of the bottle 30 is made higher than an atmospheric pressure, and the inner pressure of the bottle 30 is the same pressure as the inner pressure of the filling head tank 75.

Next, the inside of the bottle 30 is filled with a sterilized carbonated beverage from the beverage supply line 73 (filling process). In this case, the sterilized carbonated beverage passes through the beverage supply line 73 from the filling head tank 75, and is injected into the inside of the bottle 30.

Next, the supply of the sterilized carbonated beverage from the beverage supply line 73 is stopped. Next, a snift line (not shown) is opened, and gas inside the bottle 30 is exhausted from the snift line. In this manner, the pressure inside the bottle 30 becomes equal to the atmospheric pressure, and the filling of the bottle 30 with the sterilized carbonated beverage is completed.

(Case of Non-Sterilized Carbonated Beverage)

Next, a case where a non-sterilized carbonated beverage is produced by the beverage preparation unit 40 and the bottle 30 is filled with the non-sterilized carbonated beverage by the beverage filling unit 20 will be described.

First, in a similar manner as in the case of producing a sterilized carbonated beverage, the raw material liquid preparation unit 46 prepares the raw material liquid (non-sterilized beverage) from the beverage raw material. Next, the non-sterilized beverage prepared in the raw material liquid preparation unit 46 is sent to the beverage cooling unit 43 via the first bypass filling line 50C.

Alternatively, the non-sterilized beverage is sent from the raw material liquid preparation unit 46 to the first aseptic tank 42 via the second bypass filling line 50D, and temporarily stored in the first aseptic tank 42 (first storage process). After the above, the non-sterilized beverage is sent from the first aseptic tank 42 to the beverage cooling unit 43.

Next, the non-sterilized beverage is cooled to, for example, 1° C. or more and 10° C. or less in the beverage cooling unit 43 (cooling process). Next, the non-sterilized beverage is sent to the carbonated beverage production unit 44 such as a carbonator. In the carbonated beverage production unit 44, carbon dioxide gas is injected into the non-sterilized beverage cooled by the beverage cooling unit 43, and a non-sterilized carbonated beverage is produced (carbonated beverage producing process).

Next, the non-sterilized carbonated beverage from the carbonated beverage production unit 44 is sent to the second aseptic tank 45. The non-sterilized carbonated beverage sent to the second aseptic tank 45 is temporarily stored in the second aseptic tank 45 (second storage process). Next, the non-sterilized carbonated beverage from the second aseptic tank 45 is sent to the first filling line 50A side via the switching valve 47 and is fed to the filling head tank 75 of the beverage filling unit 20. The non-sterilized carbonated beverage sent to the filling head tank 75 is temporarily stored in the filling head tank 75 (third storage process).

After the above, like the case of the sterilized carbonated beverage, in the beverage filling unit 20, the bottle 30 in an empty state is filled with the non-sterilized carbonated beverage stored in the filling head tank 75 (filling process).

(Case of Sterilized Non-Carbonated Beverage)

Next, a case where a sterilized non-carbonated beverage is produced by the beverage preparation unit 40 and the bottle 30 is filled with the sterilized non-carbonated beverage by the beverage filling unit 20 will be described.

First, in a similar manner as in the case of producing a sterilized carbonated beverage, the raw material liquid preparation unit 46 prepares the raw material liquid from the beverage raw material. Next, the raw material liquid is sterilized in the beverage sterilization unit 41 to produce a sterilized beverage (sterilization process).

The sterilized beverage sterilized by the beverage sterilization unit 41 is sent to the first aseptic tank 42, and temporarily stored in the first aseptic tank 42 (first storage process). Next, the sterilized beverage (sterilized non-carbonated beverage) from the first aseptic tank 42 is sent to the first filling line 50A via the switching valve 47. Note that the switching valve 47 is switched in advance so as to send the sterilized beverage (sterilized non-carbonated beverage) to the first filling line 50A side.

Next, the sterilized non-carbonated beverage from the switching valve 47 is sent to the first filling line 50A side, and is fed to the filling head tank 75 of the beverage filling unit 20. The sterilized non-carbonated beverage sent to the filling head tank 75 is temporarily stored in the filling head tank 75 (third storage process).

Note that, the beverage (raw material liquid, sterilized beverage, or sterilized non-carbonated beverage) is sent from the raw material liquid preparation unit 46 to the beverage filling unit 20 via the beverage sterilization unit 41, the first aseptic tank 42, and the switching valve 47 sequentially, and, at this time, the beverage passes through the four beverage supply system pipes 60*a* to 60*d* sequentially.

After the above, in the beverage filling unit 20, the empty bottle 30 in an empty state is filled with the sterilized non-carbonated beverage stored in the filling head tank 75.

During this time, in the beverage filling unit 20, the inside of the bottle 30 is filled with the sterilized non-carbonated beverage from the beverage supply line 73 (filling process). In this case, the sterilized non-carbonated beverage is injected into the inside of the bottle 30 from the filling head tank 75 through the beverage supply line 73.

Referring back to FIG. 1, the bottle 30 filled with the sterilized carbonated beverage, non-sterilized carbonated beverage, or sterilized non-carbonated beverage in the beverage filling unit 20 in the above manner is conveyed by the convey wheel 12 to the cap attachment unit 16.

On the other hand, the cap 33 is previously sterilized by the cap sterilization unit 25 (cap sterilization process). The cap 33 sterilized by the cap sterilization unit 25 is attached to the mouth of the bottle 30 conveyed from the beverage filling unit 20 in the cap attachment unit 16. In this manner, the product bottle 35 which has the bottle 30 and the cap 33 is obtained (cap attachment process).

After the above, the product bottle 35 is conveyed from the cap attachment unit 16 to the product bottle conveyor 22 and is carried toward the outside of the beverage aseptic filling system 10.

Note that the processes from the sterilization process to the cap attachment process are performed in a sterile atmosphere, that is, in a sterile environment, surrounded by the sterile chamber 13. After the sterilization treatment, sterile air of positive pressure is supplied into the sterile chamber 13 so that the sterile air is always blown toward the outside of the sterile chamber 13.

Note that a production (conveying) speed of the bottle 30 in the beverage aseptic filling system 10 is preferably 100 bpm or more and 1500 bpm or less. Here, bottle per minute (bpm) refers to a conveying speed of the bottle 30 per minute.

As described above, according to the present embodiment, the switching valve 47 selectively supplies the beverage toward either one of the first filling line 50A and the second filling line 50B. This allows the bottle 30 to be filled with both carbonated and non-carbonated beverages using the same beverage aseptic filling system 10.

Further, according to the present embodiment, when the beverage with which the bottle 30 is filled by the beverage filling unit 20 is a carbonated beverage, the beverage from the switching valve 47 is supplied to the beverage filling unit 20 via the second filling line 50B. On the other hand, in a case where the beverage with which the bottle 30 is filled by the beverage filling unit 20 is a non-carbonated beverage, the beverage from the switching valve 47 is supplied to the beverage filling unit 20 via the first filling line 50A without passing through the second filling line 50B. That is, when the bottle 30 is filled with a non-carbonated beverage, the beverage does not pass through the second filling line 50B. Accordingly, there is no need to clean and sterilize the second filling line 50B by, for example, CIP treatment and the like, and the work can be simplified.

Further, according to the present embodiment, the second filling line 50B is configured in a loop shape, and the carbonated beverage from the second filling line 50B is sent to the first filling line 50A via the switching valve 47. In this manner, it is possible to switch between the filling of the carbonated beverage and the filling of the non-carbonated beverage using only a single one of the switching valve 47, and a circulation channel of the beverage can be simplified.

Further, according to the present embodiment, the raw material liquid preparation unit 46 and the beverage cooling unit 43 are bypass-connected by the first bypass filling line (third filling line) 50C not via the beverage sterilization unit 41. In this manner, in a case where the beverage with which the bottle 30 is filled by the beverage filling unit 20 is a non-sterilized carbonated beverage, the beverage (raw material liquid) from the raw material liquid preparation unit 46 can be supplied to the beverage cooling unit 43 via the first bypass filling line 50C. Further, the same beverage aseptic filling system 10 can be used to fill the bottle 30 with both the sterilized carbonated beverage for which sterilization treatment is performed and the non-sterilized carbonated beverage that does not require sterilization. That is, when the bottle 30 is filled with a sterilized carbonated beverage, the beverage sterilization unit 41 is used to sterilize the raw material liquid, and the sterilized beverage is sent to the beverage cooling unit 43. On the other hand, in a case where the bottle 30 is filled with the non-sterilized carbonated beverage, the raw material liquid is sent from the first bypass filling line 50C to the beverage cooling unit 43 without using the beverage sterilization unit 41. In this manner, in a case where a bottle is filled with the non-sterilized carbonated beverage, the beverage does not pass through the beverage sterilization unit 41 and the first aseptic tank 42. Accordingly, the beverage sterilization unit 41 and the first aseptic tank 42 do not need to be cleaned or sterilized by, for example, the CIP treatment, and the work can be simplified. Further, energy in the beverage sterilization unit 41 and the first aseptic tank 42 can be saved.

Further, according to the present embodiment, the first aseptic tank 42 for storing the sterilized beverage from the beverage sterilization unit 41 or the non-sterilized beverage not passing through the beverage sterilization unit 41 is provided between the beverage sterilization unit 41 and the switching valve 47. In this manner, the sterilized beverage sterilized by the beverage sterilization unit 41 or the non-sterilized beverage that does not require sterilization can be temporarily stored in the first aseptic tank 42, which can serve as a buffer. Specifically, it is possible to adjust a difference in the amount of the sterilized beverage or the non-sterilized beverage caused by a difference in the processing speed between the beverage sterilization unit 41 and the beverage filling unit 20 or the beverage cooling unit 43.

Further, according to the present embodiment, the raw material liquid preparation unit 46 and the first aseptic tank 42 are connected by the second bypass filling line 50D not via the beverage sterilization unit 41. In this manner, the same beverage aseptic filling system 10 can be used to fill the bottle 30 with both the sterilized carbonated beverage for which sterilization treatment is performed and the non-sterilized carbonated beverage that does not require sterilization. In this case, since the beverage does not pass through the beverage sterilization unit 41, there is no need to clean or sterilize the beverage sterilization unit 41 by, for example, CIP treatment, and the work can be simplified. Further, energy in the beverage sterilization unit 41 can be saved.

Further, according to the present embodiment, the second aseptic tank 45 for storing the carbonated beverage from the carbonated beverage production unit 44 is provided between the carbonated beverage production unit 44 and the beverage filling unit 20. In this manner, the carbonated beverage produced by the carbonated beverage production unit 44 can be temporarily stored in the second aseptic tank 45, which can serve as a buffer. Specifically, it is possible to adjust a difference in the amount of the carbonated beverage caused by a difference in the processing speed between the carbonated beverage production unit 44 and the beverage filling unit 20.

Note that, in the above, the container sterilization of the bottle 30, the preform, the cap 33, and the like is described by exemplifying the case of using a disinfectant made from hydrogen peroxide. However, the present invention is not limited to the above, and sterilization may be performed by a disinfectant, such as peracetic acid, and an electron beam. Further, when the non-sterilized beverage is produced, the non-sterilized beverage may be produced in an aseptic environment after the inside of the chamber of the beverage filling unit (aseptic filling machine) 20 is cleaned and sterilized. This allows for the production of a beverage in a more hygienic environment than normal.

The invention claimed is:

1. A beverage aseptic filling system for both a carbonated beverage and a non-carbonated beverage, the beverage aseptic filling system comprising:

a raw material liquid preparation unit that prepares a raw material liquid;

a beverage sterilization unit that is connected to the raw material liquid preparation unit and sterilizes a beverage;

a beverage filling unit that fills a container with the beverage;

a switching valve, which is a valve manifold, that is provided between the beverage sterilization unit and the beverage filling unit;

a first aseptic tank for storing the beverage from the beverage sterilization unit that is provided between the beverage sterilization unit and the switching valve;

a first filling line that is provided between the switching valve and the beverage filling unit;

a second filling line that is connected to the switching valve and has a beverage cooling unit for cooling the beverage and a carbonated beverage production unit for injecting carbon dioxide gas into the beverage disposed therein; and a control unit that controls the switching valve, wherein the switching valve supplies the beverage to either one of the first filling line and the second filling line selectively as controlled by a control signal from the control unit so as to switch a feeding direction between the first filling line and the second filling line, and the second filling line is configured in a loop, and a beverage from the second filling line is sent to the first filling line via the switching valve.

2. The beverage aseptic filling system according to claim 1, wherein in a case where a beverage with which the container is filled by the beverage filling unit is a carbonated beverage, the beverage from the switching valve is supplied to the beverage filling unit via at least the second filling line, and in a case where a beverage with which the container is filled by the beverage filling unit is a non-carbonated beverage, the beverage from the switching valve is supplied to the beverage filling unit via the first filling line without passing through the second filling line.

3. The beverage aseptic filling system according to claim 1, wherein the raw material liquid preparation unit and the beverage cooling unit are connected by a third filling line not via the beverage sterilization unit.

4. The beverage aseptic filling system according to claim 1, wherein a second aseptic tank for storing the beverage from the carbonated beverage production unit is provided between the carbonated beverage production unit and the beverage filling unit.

5. A carbonated beverage aseptic filling system for both a sterilized carbonated beverage for which sterilization treatment is performed and a non-sterilized carbonated beverage that does not require sterilization, the carbonated beverage aseptic filling system comprising:

a raw material liquid preparation unit that prepares a raw material liquid;

a beverage sterilization unit that is connected to the raw material liquid preparation unit and sterilizes a beverage;

a beverage cooling unit that is connected to the beverage sterilization unit via a valve manifold and cools the beverage;

a carbonated beverage production unit that is connected to the beverage cooling unit and injects carbon dioxide gas into the beverage; and a beverage filling unit that is connected to the carbonated beverage production unit via the valve manifold and fills a container with the beverage which is supplied from the carbonated beverage production unit via the valve manifold, wherein the raw material liquid preparation unit and the beverage cooling unit are connected by a first bypass filling line not via the beverage sterilization unit and the valve manifold.

6. The carbonated beverage aseptic filling system according to claim 5, wherein a first aseptic tank for storing the beverage is provided between the beverage sterilization unit and the valve manifold.

7. The carbonated beverage aseptic filling system according to claim 6, wherein the raw material liquid preparation unit and the first aseptic tank are connected by a second bypass filling line not via the beverage sterilization unit.

8. The carbonated beverage aseptic filling system according to claim 5, wherein a second aseptic tank for storing the beverage from the carbonated beverage production unit is provided between the carbonated beverage production unit and the valve manifold.

9. A carbonated beverage aseptic filling system for both a sterilized carbonated beverage for which sterilization treatment is performed and a non-sterilized carbonated beverage that does not require sterilization, the carbonated beverage aseptic filling system comprising:

a raw material liquid preparation unit that prepares a raw material liquid;

a beverage sterilization unit that is connected to the raw material liquid preparation unit and sterilizes a beverage;

a first aseptic tank that is connected to the beverage sterilization unit and stores the beverage;

a beverage cooling unit that is connected to the first aseptic tank via a valve manifold and cools the beverage;

a carbonated beverage production unit that is connected to the beverage cooling unit and injects carbon dioxide gas into the beverage; and a beverage filling unit that is connected to the carbonated beverage production unit via the valve manifold and fills a container with the beverage which is supplied from the carbonated beverage production unit via the valve manifold, wherein the raw material liquid preparation unit and the first aseptic tank are connected by a second bypass filling line not via the beverage sterilization unit.

* * * * *